US006158451A

United States Patent [19]

Wu

[11] Patent Number: 6,158,451

[45] Date of Patent: Dec. 12, 2000

[54] LAMP MEANS DETACHABLY SECURABLE ON UMBRELLA TOP

[76] Inventor: Tsun-Zong Wu, 8F, No. 76, Lane 103, Nei-Hu Raod, Sec. 2, Taipei, Taiwan, 114

[21] Appl. No.: 09/307,322

[22] Filed: May 7, 1999

[51] Int. Cl.[7] ..... A45B 3/00

[52] U.S. Cl. ..... 135/16; 135/910

[58] Field of Search ..... 135/16, 910; 362/84, 362/95, 102, 157, 159, 194, 196, 374

[56] References Cited

U.S. PATENT DOCUMENTS

| | | | |
|---|---|---|---|
| 4,020,858 | 5/1977 | Wilson | 135/20.1 |
| 4,031,381 | 6/1977 | Carver | 135/910 |
| 6,075,322 | 6/2000 | Pauly | 362/84 |

*Primary Examiner*—Beth A. Stephan

[57] ABSTRACT

A lamp device includes: an illuminator selected from a light-emitting diode (LED), a bulb and any other lamps electrically connected with a power source of batteries and a switch as stored in an adapter casing, which is detachably securable or attachable on an umbrella top end portion, thereby enabling an umbrella to be illuminated in an easy, convenient and selective way.

16 Claims, 10 Drawing Sheets

LAMP MEANS DETACHABLY SECURABLE ON UMBRELLA TOP

BACKGROUND OF THE INVENTION

A conventional lamp L as fixed on a top end of an umbrella shaft S is shown in FIG. 13, in which the lamp L is electrically connected to the power source of batteries B as stored in the grip G by a positive wire W1 and a negative wire W2 passing through the shaft S and controlled by a switch P provided on the shaft S for switching on or off the lamp L.

The complete electric circuit for powering the lamp L should be made in a factory production when manufacturing the umbrella. It is difficult for maintaining the lamp and the electrical system because all the elements are almost deadly fixed on the umbrella.

Unless it is made from an original umbrella plant, any conventional umbrella can not be attached or installed with an illuminator thereon in an easy or convenient way.

The present inventor has found the drawbacks of conventional illuminating umbrella and invented the present lamp means attachable to an umbrella.

SUMMARY OF THE INVENTION

The object of the present invention is to provide a lamp device including: an illuminator selected from a light-emitting diode (LED), a bulb and any other lamps electrically connected with a power source of batteries and a switch as stored in an adapter casing, which is detachably securable or attachable on an umbrella top end portion, thereby enabling an umbrella to be illuminated in an easy, convenient and selective way.

BRIEF DESCRIPTION OF THE DRAWINGS

FIG. 5 is a longitudinal sectional drawing of the present invention when turned on.

FIG. 11 shows the lamp means when turned on.

DETAILED DESCRIPTION

Figure 1:
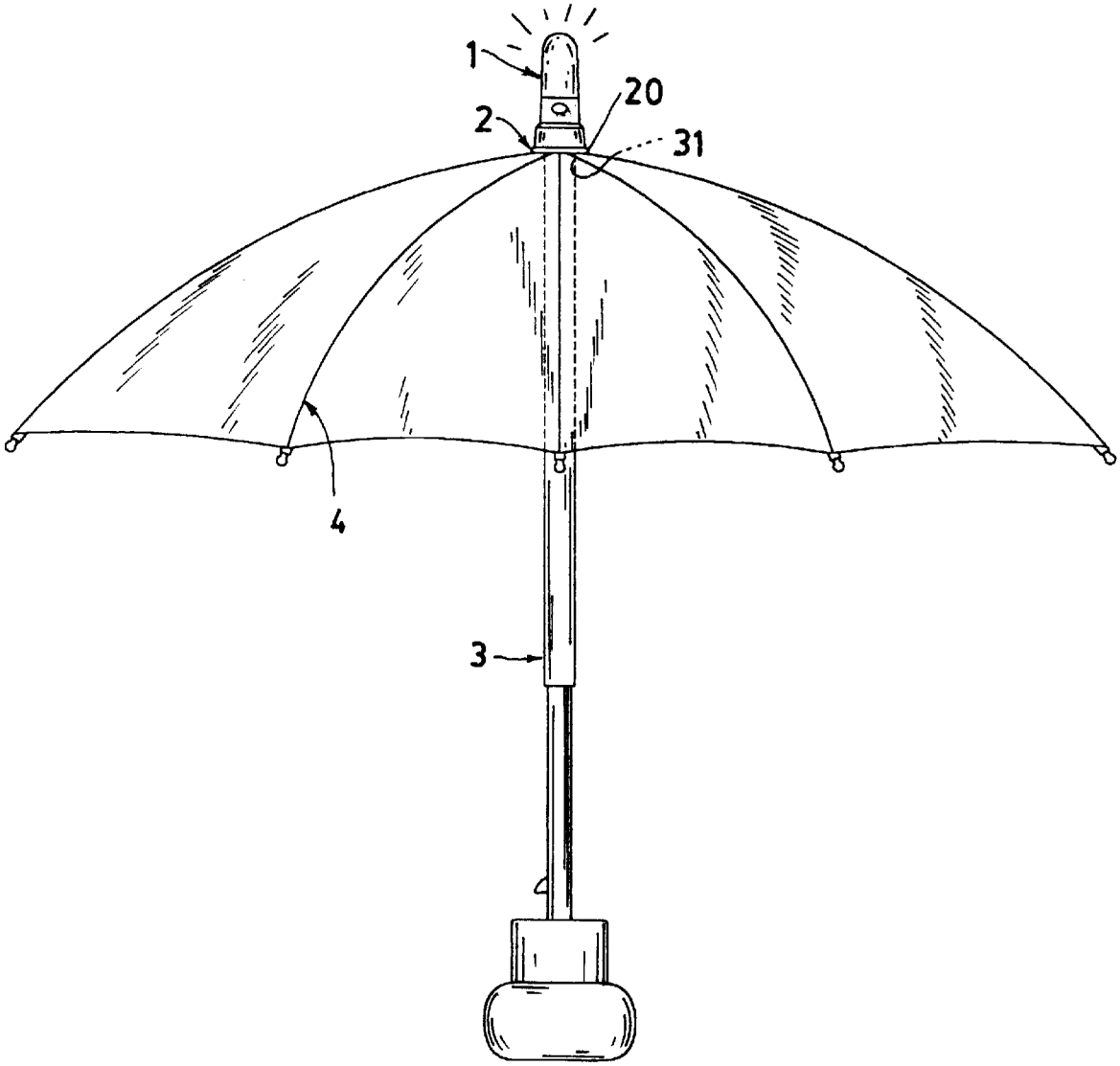
FIG. 1 is an illustration of the present invention as secured on an opened umbrella.

As shown in FIGS. 1≈3, the lamp means of the present invention comprises: a lamp device 1; and an adapter 2 coupled with the lamp device 1, and detachably connected between a central shaft 3 of an umbrella and the lamp device 1.

The lamp device 1 includes: an illuminator 11 selected from a light-emitting diode (LED), a bulb or any other lamps mounted in a transparent or translucent cap 12 secured on a lamp holder 13 having a lower connecting portion 14 formed on a lower portion of the lamp holder 13 to be connected, coupled or engaged with the adapter 2.

The illuminator 11 is electrically connected with a power source of batteries 10 stored in the lamp holder 13 having a switch 15 formed on the lamp holder 13 for switching on or off the power supply from the power source 10 to the illuminator 11. The switch 15 may be a push button, a rocker type switch or any other types of switch for turning on or off the illuminator 11.

Figure 2:
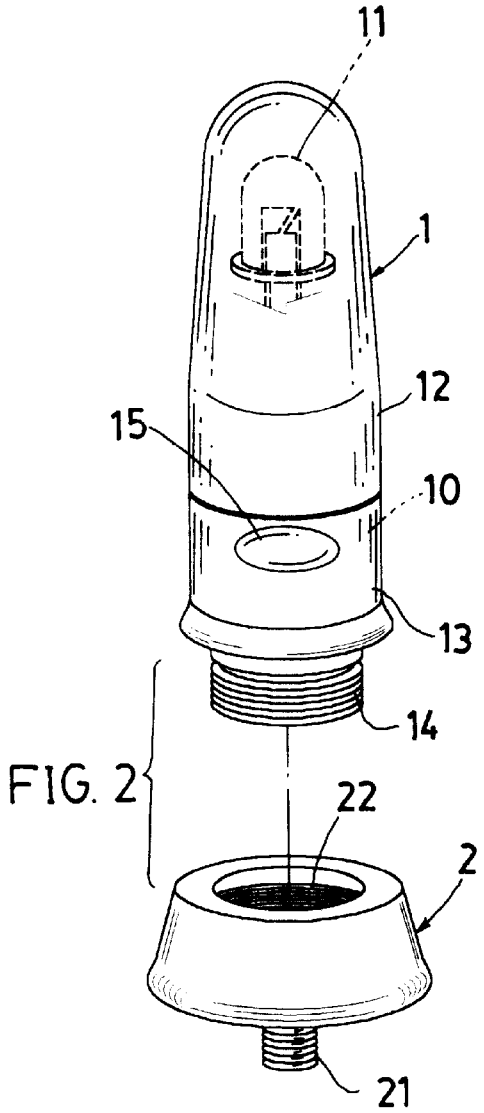
FIG. 2 is a perspective view of the elements of the present invention.

The lower connecting portion 14 of the lamp device 1 may be a male threaded plug as shown In FIG. 2 to be engageable with a female-threaded socket 22 recessed in the adapter 2 having a male-threaded screw portion 21 rotatably engageable with a female-threaded hole formed in a top end portion 31 of the umbrella shaft 3.

Figure 3:
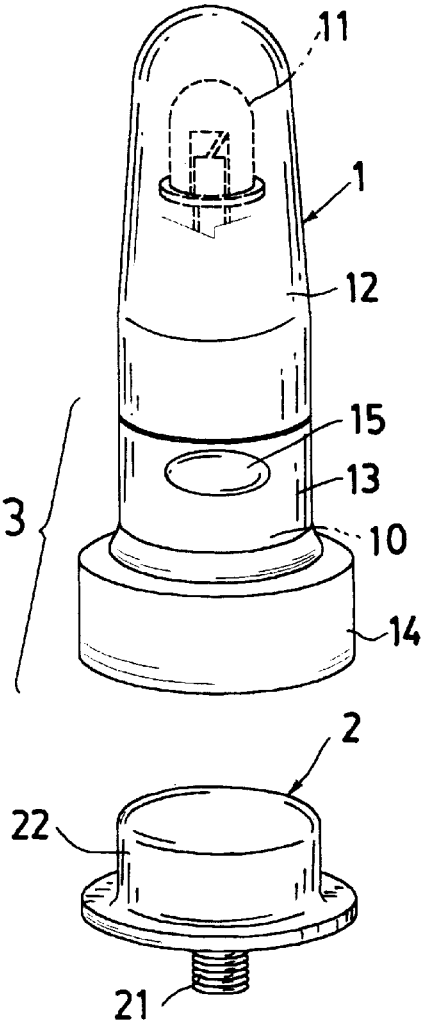
FIG. 3 shows another modification for the elements of the present invention.

As shown in FIG. 3, the lower connecting portion 14 of the lamp device 1 may also be formed with a cylindrical opening recessed in a bottom of the lower connecting portion 14 to be engageable with a cylindrical plug portion 22 formed on an upper portion of the adapter 2 which includes a male-threaded screw portion 21 rotatably engageable with a female-threaded hole formed in the top end portion 31 of the shaft 3.

A top cap member as plugged in a top end of a conventional two-fold umbrella may be removed and replaced with the adapter 2 of the present invention. The lamp device 1 of the present invention will then be embedded, engaged or secured with the adapter 2 to form an illuminating umbrella of which the illuminator 11 in the lamp device 1 will be switched on for illumination or be switched off when the illumination is no longer necessary.

The lamp device 1 may be dismantled from the top end of the umbrella for maintenance or for replacing new batteries 10 in the lamp holder 13.

The lamp means of the present invention can be operated or maintained individually and independently with respect to the umbrella.

The adapter 2 may be formed with a flange or periphery 20 for covering the upper central portion of an umbrella cloth 4 as secured on an umbrella rib assembly pivotally connected with the central shaft 3 for a beautiful appearance of the umbrella (FIG. 1).

Figure 4:
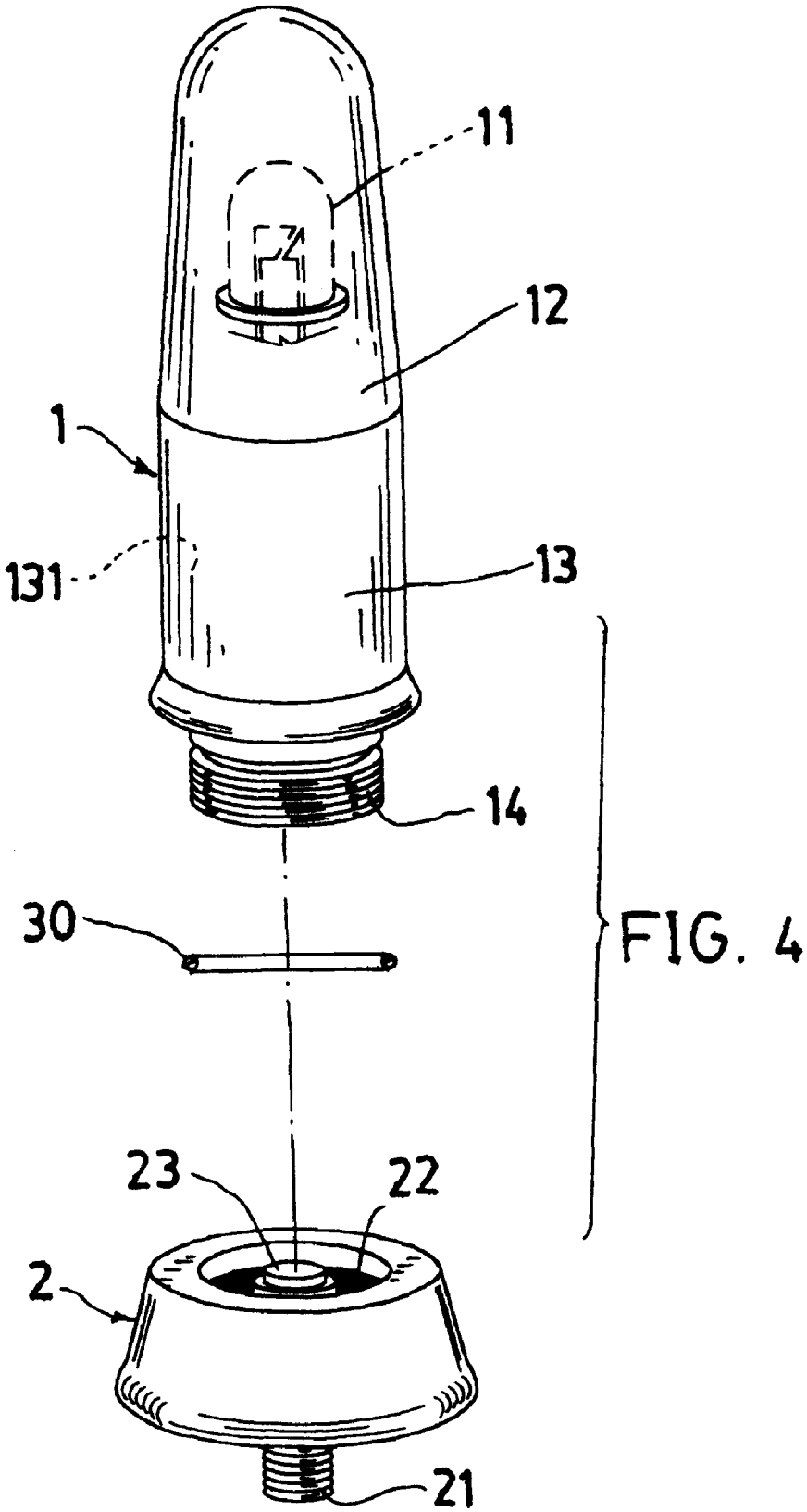
FIG. 4 is a perspective exploded view of the present invention for rotatively switching on or off the lamp means of the present invention.

As shown in FIGS. 4≈6, the adapter 2 is modified to form an actuating stem 23 protruding upwardly from a central bottom portion of the female-threaded socket 22 as recessed in an upper portion of the adapter 2.

Figure 5:
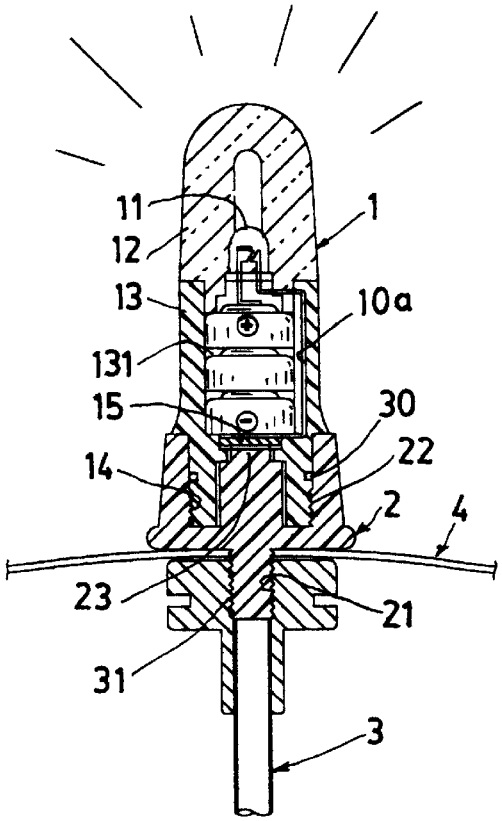
Figure 6:
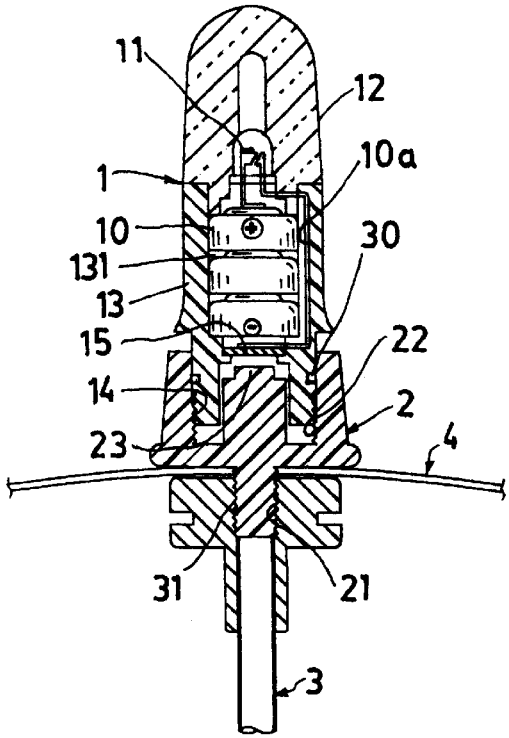
FIG. 6 is a longitudinal sectional drawing of the present invention when turned off.

The lamp device 1 includes: the lamp holder 13 having a battery chamber 131 defined in an interior in the lamp holder 13 for storing the batteries 10 of the power source in the chamber 131; a contactor switch 15 electrically connected to a negative pole of the power source (batteries) 10 and connected to the negative pole of the illuminator 11 by a resilient conducting member such as a strip or wire 10*a*, with the contactor switch 15 resiliently held in a lower connecting portion 14 of the lamp holder 13 to be spaced between the power source of batteries 10 and the actuating stem 23 of the adapter 2 when engaged with the lamp device 1 as shown in FIGS. 5, 6; and a packing ring 30 disposed around the lower connecting portion 14 of the lamp device 1 for sealing an annular aperture between the lower connecting portion 14 of the lamp device 1 and the socket 22 of the adapter 2.

Upon rotation of the lower connecting portion 14 of the lamp device 1 in a first direction to be downwardly plugged into the socket 22 of the adapter 2, the contactor switch 15 will be urged by the actuating stem 23 to be firmly contacted with the negative pole of the batteries 10 for completing the electrical circuit of the illuminator 11 for turning on the illuminator 11 as shown in FIG. 5 since the positive pole is connected with the positive pole of the batteries while the negative pole of the illuminator 11 is connected with the negative pole of the batteries by means of the contactor switch 15.

Upon rotation of the lamp device 1 in a second direction to be separated from the adapter 2, the contactor switch 15 will be restored when leaving from the actuating stem 23 of the adapter 2 to be separated from the batteries 10, thereby disconnecting the power supply from the batteries to the illuminator 11 to turn off the illuminator 11 as shown in FIG. 6.

The casing of the lamp device 1 and the adapter 2 should be made of electrically insulative materials.

Figure 7:
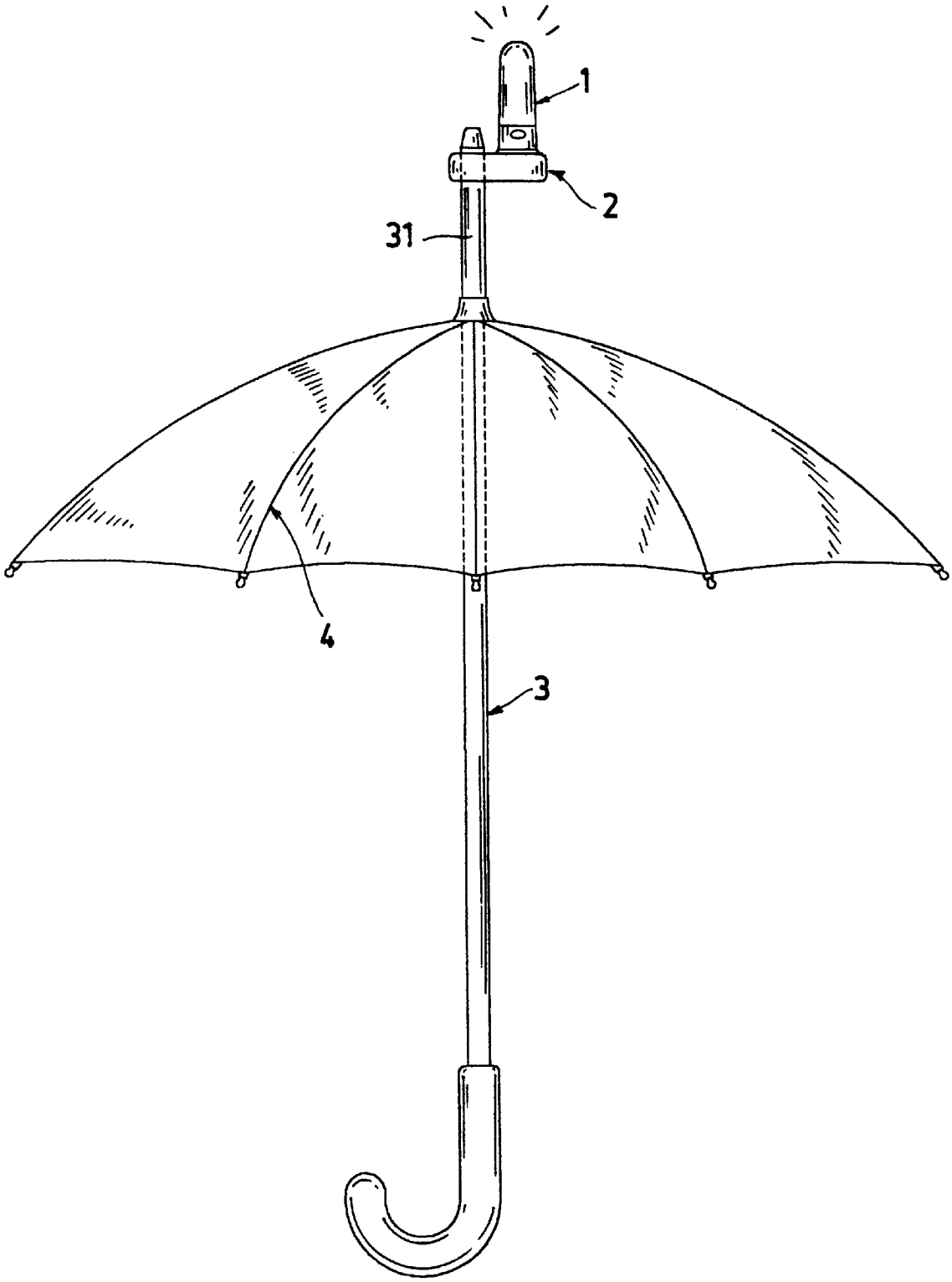
FIG. 7 shows another preferred embodiment of the present invention on an opened umbrella.
Figure 8:
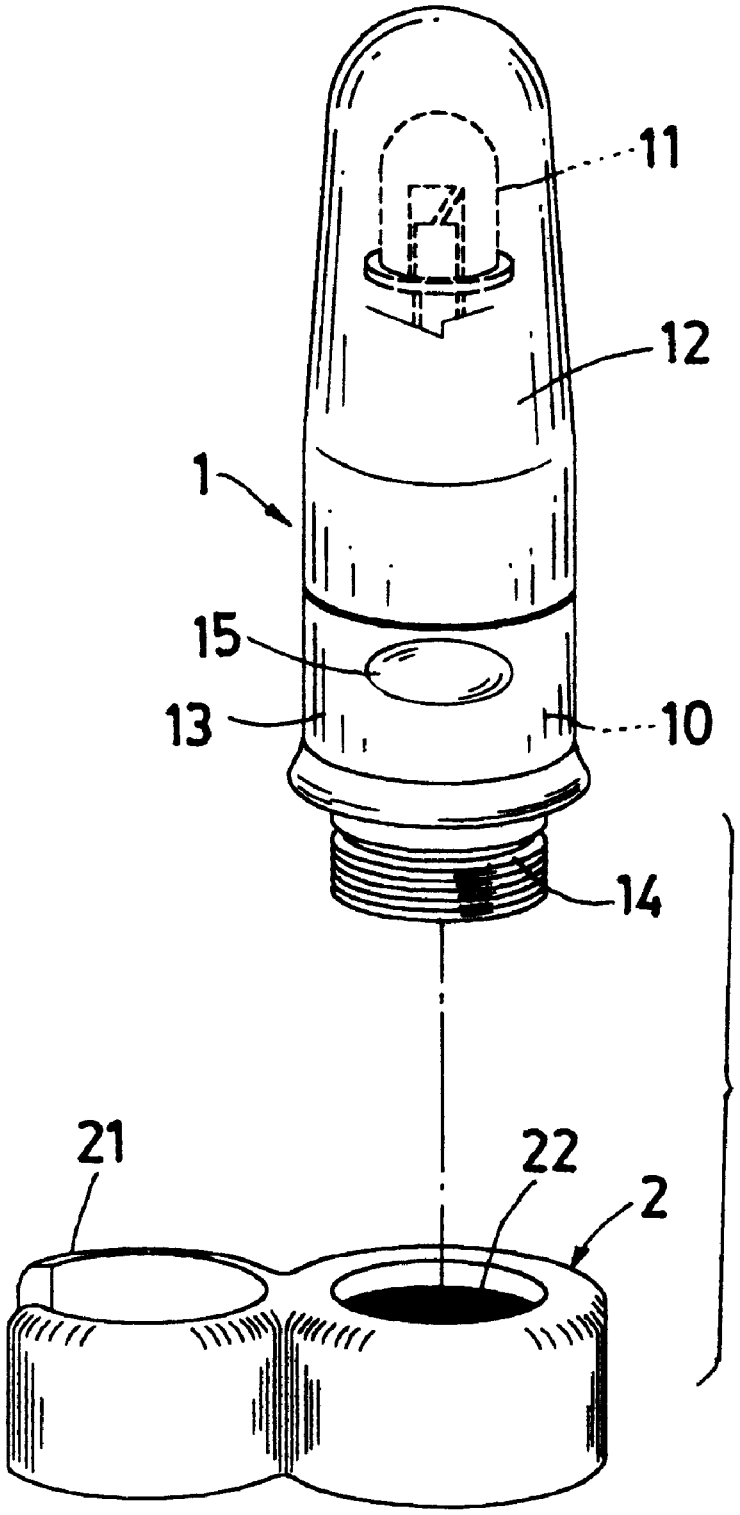
FIG. 8 is a perspective view of the elements of the present invention as shown in FIG. 7.
Figure 9:
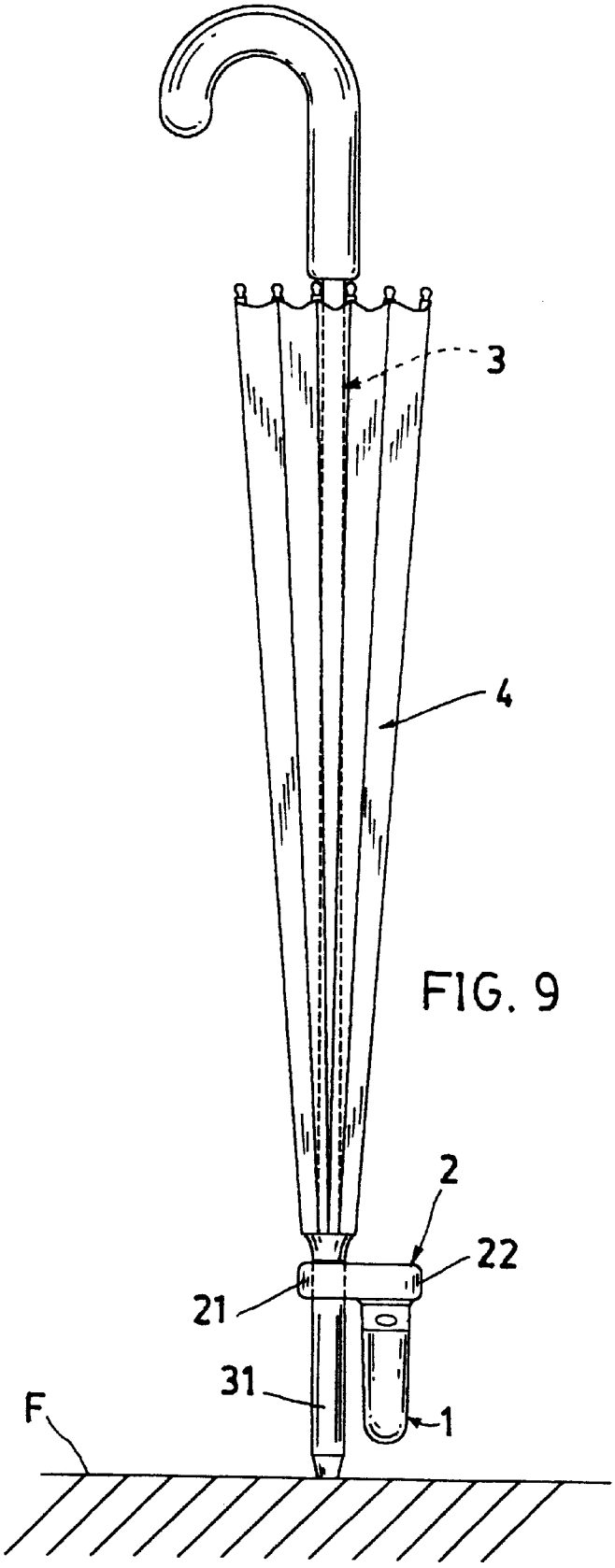
FIG. 9 shows a closed umbrella of the present invention by touching an umbrella top end on a ground surface.

As shown in FIGS. 7≈9, the adapter 2 is modified to form a clamp member 21 juxtapositioned to the socket 22 of the adapter to be fastened to a top end portion 31 of the umbrella shaft 3. The clamp member 21 is movably clamped on the top end portion 31 of the shaft 1; whereby upon inversion of the umbrella when folded to allow the top end portion 31 of the shaft to touch a ground surface F as shown in FIG. 9, the lamp device 1 may be retracted towards the umbrella cloth 4 to prevent an impact damage to the lamp device.

The clamp member 21 has a cross section of C shape or U shape for snugly clamping the shaft 1.

Other modifications of the clamp member 21 may be further made in this invention. For instance, an elastic collar having a central hole engageable with the umbrella shaft I may be provided to be fastened on the umbrella top end.

Figure 10:
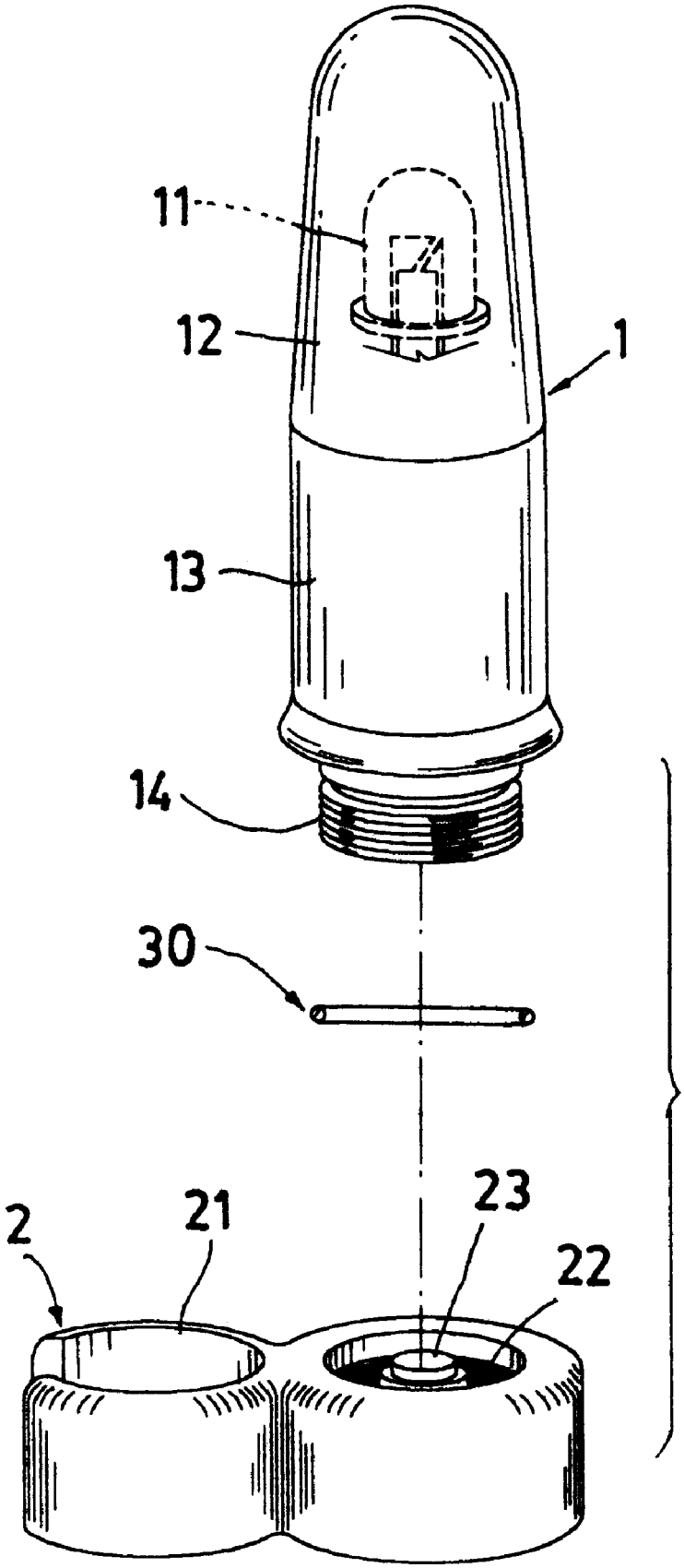
FIG. 10 is an exploded view of the present invention as modified from FIG. 8 for rotatively switching on or off the lamp means.
Figure 11:
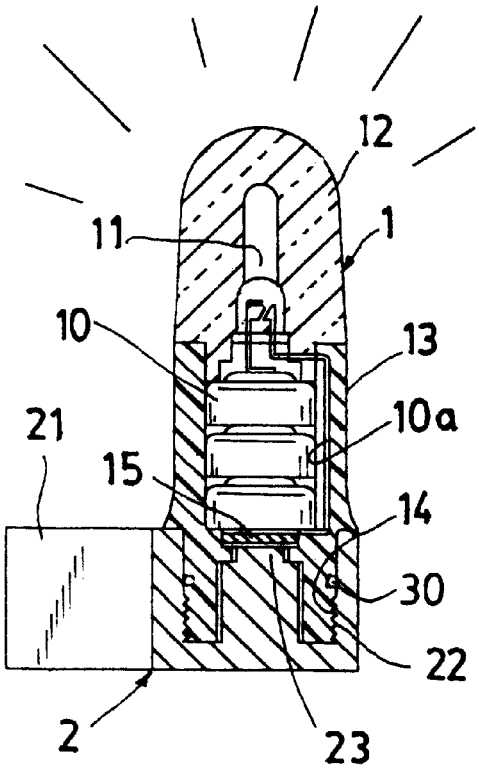
Figure 12:
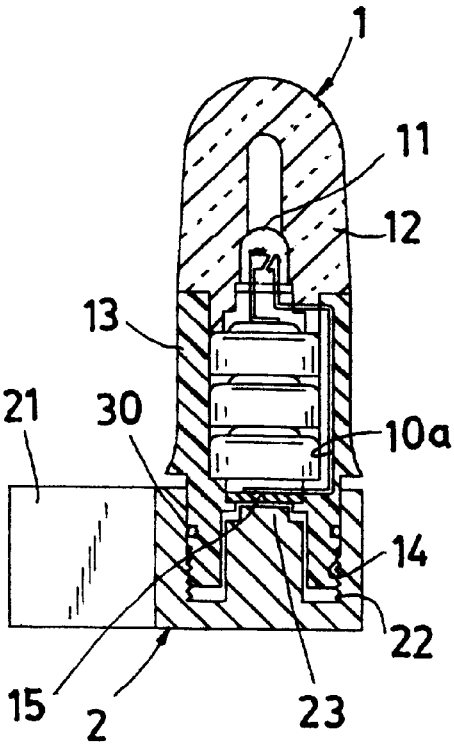
FIG. 12 shows the lamp means when turned off.
Figure 13:
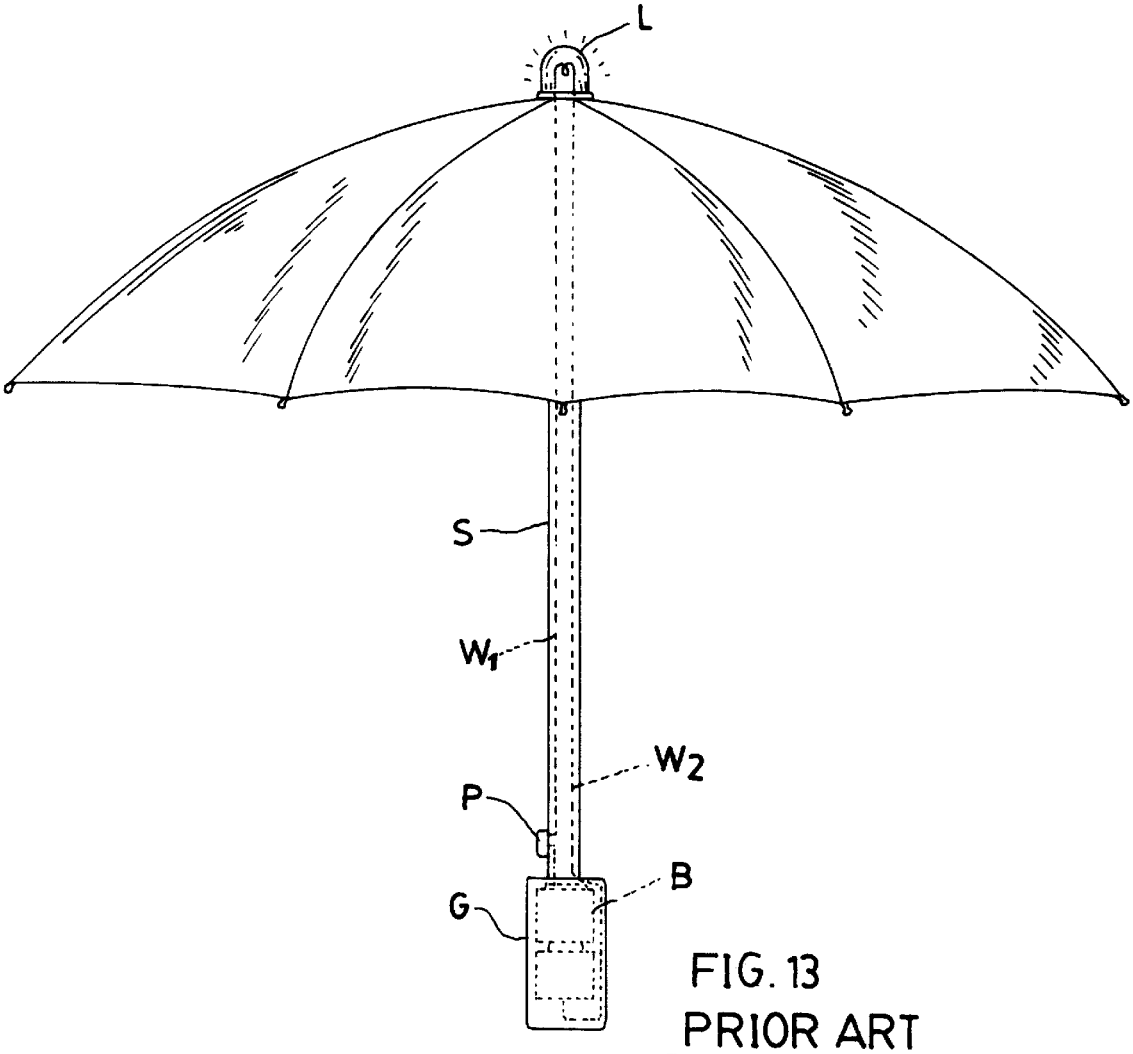
FIG. 13 PRIOR ART
FIG. 13 shows a conventional illuminating umbrella.

The preferred embodiment as shown in FIGS. 10≈12 is a modification based upon that as shown in FIGS. 4≈6 as aforementioned, in which the lower plug 14 is modified to be a clamp member 21 juxtapositioned to the socket 22 of the adapter 2 to be clamped on a top end portion 31 of the umbrella.

The preferred embodiments as shown in FIGS. 7≈12 may be applicable on a single-fold umbrella, especially as shown in FIG. 7.

The present invention may be modified without departing from the spirit and scope of this invention.

I claim:

1. A lamp means detachably securable on an umbrella comprising:

a lamp device having an illuminator electrically connected to a power source of at least a battery and a switch operatively switching on or off a power supply from said power source to said illuminator; and an adapter detachably coupled with said lamp device and detachably securable to a top end portion of an umbrella shaft; whereby upon powering of said illuminator in said lamp device, the illuminator on the top end portion will be turned on for illumination; and upon dismantling of said adapter from said shaft, said adapter and said lamp device will be removed and separated from said umbrella.

2. A lamp means detachably securable on an umbrella according to claim 1, wherein said lamp device includes a transparent cap mounted on a lamp holder for mounting said illuminator in said cap; and a lower connecting portion formed on a lower portion of the lamp holder to be detachably engageable with said adapter.

3. A lamp means detachably securable on an umbrella according to claim 2, wherein said lower connecting portion of said lamp device is a male-threaded plug; and said adapter including a female-threaded socket formed on an upper portion of said adapter to be engageable with said male-threaded plug of said lamp device.

4. A lamp means detachably securable on an umbrella according to claim 2, wherein said lower connecting portion of said lamp device is formed with a cylindrical opening in a bottom of said lower connecting portion; and said adapter having a cylindrical plug portion formed on an upper portion of said adapter to be engageable with said cylindrical opening in said lower connecting portion of said lamp device.

5. A lamp means detachably securable on an umbrella according to claim 2, wherein said lamp device includes: a battery chamber defined therein for storing said battery in said battery chamber, a contactor switch resiliently held in said lower connecting portion and electrically connected to said illuminator; said contactor switch normally separable from said battery and operatively urged by said adapter to close a power circuit between said battery and said illuminator for turning on the illuminator.

6. A lamp means detachably securable on an umbrella according to claim 5, wherein said adapter includes an actuating stem protruding upwardly from a central bottom portion of a socket in said adapter; whereby upon a downward plugging of said lower connecting portion of said lamp device into said socket in said adapter, said contactor switch will be urged by said actuating stem in said adapter to be contacted with said battery to close a power circuit between said battery and said illuminator.

7. A lamp means detachably securable on an umbrella according to claim 6, wherein said lower connecting portion includes a packing ring disposed around said lower connecting portion to be engageable with said socket in said adapter.

8. A lamp means detachably securable on an umbrella according to claim 5, wherein said contactor switch is electrically connected to said illuminator by a resilient conducting member.

9. A lamp means detachably securable on an umbrella according to claim 1, wherein said adapter includes a first connecting portion detachably coupled with said lamp device; and a second connecting portion juxtapositioned to said first connecting portion to be detachably securable to said top end portion of said shaft.

10. A lamp means detachably securable on an umbrella according to claim 9, wherein said lamp device includes a lower connecting portion formed as a male-threaded plug; and said adapter including a female-threaded socket formed in said first connecting portion of said adapter to be engageable with said male-threaded plug of said lamp device.

11. A lamp means detachably securable on an umbrella according to claim 9, wherein said lamp device includes a lower connecting portion formed with a cylindrical opening in a bottom of said lower connecting portion; and said adapter having a cylindrical plug portion formed on said first connecting portion of said adapter to be engageable with said cylindrical opening in said lower connecting portion of said lamp device.

12. A lamp means detachably securable on an umbrella according to claim 9, wherein said lamp device includes:

a battery chamber defined therein for storing said battery in said battery chamber, a contactor switch resiliently held in said lower connecting portion and electrically connected to said illuminator; said contactor switch normally separable from said battery and operatively urged by said first connecting portion of said adapter to close a power circuit between said battery and said illuminator for turning on the illuminator.

13. A lamp means detachably securable on an umbrella according to claim 12, wherein said adapter includes an actuating stem protruding upwardly from a central bottom portion of a socket in said first connecting portion of said adapter; whereby upon a downward plugging of said lower connecting portion of said lamp device into said socket in said adapter, said contactor switch will be urged by said actuating stem in said adapter to be contacted with said battery to close a power circuit between said battery and said illuminator.

14. A lamp means detachably securable on an umbrella according to claim 13, wherein said lower connecting portion of said lamp device includes a packing ring disposed around said lower connecting portion of said lamp device to be engageable with said socket in said adapter.

15. A lamp means detachably securable on an umbrella according to claim 9, wherein said second connecting portion of said adapter is formed as a clamp member movably fastened to said top end portion of the umbrella shaft.

16. A lamp means detachably securable on an umbrella according to claim 9, wherein said second connecting portion of said adapter is an elastic collar detachably securable on said umbrella shaft.

* * * * *